US008424327B2

(12) United States Patent
Nishide et al.

(10) Patent No.: US 8,424,327 B2
(45) Date of Patent: Apr. 23, 2013

(54) COMPRESSOR AND REFRIGERATION APPARATUS USING THE SAME

(75) Inventors: Yohei Nishide, Sakai (JP); Katsumi Kato, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 806 days.

(21) Appl. No.: 12/597,017

(22) PCT Filed: May 1, 2008

(86) PCT No.: PCT/JP2008/058336

§ 371 (c)(1),
(2), (4) Date: Oct. 22, 2009

(87) PCT Pub. No.: WO2008/136497

PCT Pub. Date: Nov. 13, 2008

(65) Prior Publication Data

US 2010/0132389 A1 Jun. 3, 2010

(30) Foreign Application Priority Data

May 2, 2007 (JP) ..... 2007-121449
Apr. 1, 2008 (JP) ..... 2008-095188

(51) Int. Cl.
*F25B 41/00* (2006.01)
*F25B 41/04* (2006.01)

(52) U.S. Cl.
USPC ..... 62/214; 62/222

(58) Field of Classification Search ..... 62/190, 62/214, 222; 417/321; 418/55.1
See application file for complete search history.

(56) References Cited

U.S. PATENT DOCUMENTS

2006/0057012 A1 3/2006 Park et al.

FOREIGN PATENT DOCUMENTS

| | | | | |
|---|---|---|---|---|
| EP | 908712 | A1 | * | 4/1999 |
| JP | 61-212686 | A | | 9/1986 |
| JP | 06-185480 | A | | 7/1994 |
| JP | 07-293461 | A | | 11/1995 |
| JP | 07-310677 | A | | 11/1995 |
| JP | 07-324988 | A | | 12/1995 |
| JP | 10205911 | A | * | 8/1998 |
| JP | 11237126 | A | * | 8/1999 |
| JP | 2001-193646 | A | | 7/2001 |
| JP | 2001-248574 | A | | 9/2001 |
| JP | 2001248574 | A | * | 9/2001 |
| JP | 2004-317004 | A | | 11/2004 |
| JP | 2006-083853 | A | | 3/2006 |
| JP | 2006-105041 | A | | 4/2006 |

* cited by examiner

*Primary Examiner* — Chen Wen Jiang
(74) *Attorney, Agent, or Firm* — Global IP Counselors

(57) ABSTRACT

A compressor includes a casing accommodating a refrigerant passageway, a compression mechanism and a pipe. The compression mechanism is disposed in the interior of the casing to discharge compressed refrigerant into the refrigerant passageway. The pipe extends from inside of the casing to outside of the casing. The pipe includes two ends. One end is a closed end disposed in a predetermined position inside the refrigerant passageway. The other end of the pipe is an opened end disposed outside the casing. The pipe is preferably sized so that a measuring instrument can be inserted into the pipe through the opened end.

20 Claims, 10 Drawing Sheets

COMPRESSOR AND REFRIGERATION APPARATUS USING THE SAME

CROSS-REFERENCE TO RELATED APPLICATIONS

This U.S. National stage application claims priority under 35 U.S.C. §119(a) to Japanese Patent Application Nos. 2007-121449, filed in Japan on May 2, 2007, and 2008-095188, filed in Japan on Apr. 1, 2008, the entire contents of which are hereby incorporated herein by reference.

TECHNICAL FIELD

The present invention relates to a compressor, particularly to measurement of refrigerant temperature. Additionally, the present invention relates to a refrigeration apparatus using a compressor.

BACKGROUND ART

A compressor includes a compression mechanism compressing refrigerant and a casing housing the compression mechanism. Additionally, a passage is disposed in the interior of the casing for flowing refrigerant compressed by the compression mechanism.

Especially, in a refrigeration compressor, the circulation amount of refrigerant is small, and the compression mechanism is required to be driven at a high compression ratio. In the compressor of this type, refrigerant temperature tends to be high immediately after it is discharged from the compression mechanism. This may cause a trouble of the compression mechanism. In response to this, it is necessary to measure temperature of the just-discharged refrigerant and control an operation of the compressor.

Thus, a variety of arts for measuring refrigerant temperature in a compressor has been conventionally proposed. For example, in Japan Laid-open Patent Application Publication No. H06-185480, a measuring instrument has been directly disposed in a refrigerant passage. A wire, connected to the measuring instrument, penetrates through a sidewall of the refrigerant passage and is taken out of a casing.

SUMMARY OF THE INVENTION

Technical Problem

When the wire penetrates through the sidewall of the refrigerant passage, a hole is accordingly produced in the sidewall of the refrigerant passage. Accordingly, the refrigerant may leak out of the hole. Even if the hole is sealed for preventing the refrigerant from leaking out of it, the sealing is easily broken as long as the wire penetrates through the hole.

The present invention is made in view of the aforementioned situation. It is an object of the present invention to easily measure temperature of refrigerant flowing through a passage.

Solution to Problem

A compressor according to a first aspect of the present invention is a compressor for compressing refrigerant. The compressor includes a casing and a pipe. A refrigerant passage is disposed in the interior of the casing. The pipe extends from the inside to the outside of the casing. The pipe includes two ends. One of the ends is a closed end disposed in a predetermined position in the refrigerant passage. The other of the ends is an opened end disposed outside the casing.

A compressor according to a second aspect of the present invention is the compressor according to the first aspect of the present invention. The compressor further includes a compression mechanism. The compression mechanism is disposed in the interior of the casing. The compression mechanism includes a discharge port for discharging the refrigerant to the refrigerant passage after the compression mechanism compresses the refrigerant. Additionally, the predetermined position is close to the discharge port.

A compressor according to a third aspect of the present invention is the compressor according to one of the first and second aspects of the present invention. The pipe passes through a space, which is different from the refrigerant passage, in the interior of the casing. The pipe extends from the inside of the refrigerant passage to the outside of the casing. Pressure in the space is different from pressure in the refrigerant passage.

A compressor according to a fourth aspect of the present invention is the compressor according to the first aspect of the present invention. The compressor further includes a motor and a guide plate. The motor is disposed below the compression mechanism. The motor functions as a driving source of the compression mechanism. The guide plate is disposed on the outer periphery of the motor. The guide plate is configured to guide the refrigerant compressed and discharged by the compression mechanism. The predetermined position is between an inner wall of the casing and an outer surface of the guide plate.

A compressor according to a fifth aspect of the present invention is the compressor according to the first aspect of the present invention. The compressor further includes a motor, a guide plate and a fix (fixed) member. The motor is disposed below the compression mechanism. The motor functions as a driving source of the compression mechanism. The guide plate is disposed on the outer periphery of the motor. The guide plate is configured to guide the refrigerant compressed and discharged by the compression mechanism. The fix (fixed) member is configured to rotatably support a shaft connecting the compression mechanism and the motor. The fix (fixed) member includes a first recess in a lower end of the outer periphery thereof. The first recess is recessed in a direction away from an inner wall of the casing. The guide plate includes a second recess in an upper end of the outer periphery thereof. The second recess is recessed in a direction away from the inner wall of the casing. The predetermined position is inside the first recess and/or the second recess.

A compressor according to a sixth aspect of the present invention is the compressor according to the first aspect of the present invention. The compressor further includes a joint for fixing the pipe in the interior of an opening formed in the casing. The joint holds the pipe while a clearance is produced between the pipe and the inner peripheral edge of the opening.

A compressor according to a seventh aspect of the present invention is the compressor according to the sixth aspect of the present invention. The compressor further includes a temperature measuring instrument. The temperature measuring instrument is disposed in the pipe. The temperature measuring instrument is positioned further inward of the casing than the joint.

A compressor according to an eighth aspect of the present invention is the compressor according to any of the first to seventh aspects of the present invention. The compressor further includes a discharge pipe for discharging the refrigerant to the outside of the casing. The thickness of the pipe is thinner than that of the discharge pipe.

A compressor according to a ninth aspect of the present invention is the compressor according to any of the first to eighth aspects of the present invention. The compressor further includes a discharge pipe for discharging the refrigerant to the outside of the casing. The outer diameter of the pipe is smaller than that of the discharge pipe.

A compressor according to a tenth aspect of the present invention is the compressor according to any of the first to ninth aspects of the present invention. In the compressor, at least the closed end of the pipe is made of high thermal conductivity material.

A compressor according to an eleventh aspect of the present invention is the compressor according to any of the first to tenth aspects of the present invention. The compressor further includes a temperature measuring instrument disposed in the pipe.

A compressor according to a twelfth aspect of the present invention is the compressor according to the eleventh aspect of the present invention. The compressor further includes an elastic element or means for pressing the temperature measuring instrument disposed in the pipe to the inner wall of the pipe.

A compressor according to a thirteenth aspect of the present invention is the compressor according to any of the first to twelfth aspects of the present invention. In the compressor, the refrigerant includes carbon dioxide as a main constituent.

A refrigeration apparatus according to a fourteenth aspect of the present invention includes the compressor according to any of the first to thirteenth aspects of the present invention, a measuring instrument, a condenser, an expansion mechanism, an evaporator and a control unit. The measuring instrument is disposed in the pipe. The measuring instrument is configured to measure temperature of refrigerant in the interior of the compressor. The condenser communicates with the compressor. The condenser is configured to condense the refrigerant compressed by the compressor. The expansion mechanism communicates with the condenser. The expansion mechanism is configured to expand the refrigerant condensed by the condenser. The evaporator communicates with the expansion mechanism. The evaporator is configured to cool an air in a target space by evaporating the refrigerant expanded by the expansion mechanism. The control unit is configured to at least regulate an open degree of the expansion mechanism based on the temperature of the refrigerant in the interior of the compressor measured by the measuring instrument.

Advantageous Effects of Invention

According to the compressor of the first aspect of the present invention, it is easier to seal the pipe extending from the inside to the outside of the casing than to seal a wire and the like. Additionally, it is possible to measure temperature of the refrigerant flowing through the refrigerant passage only by inserting the temperature measuring instrument from the opened end of the pipe. Moreover, even when the measuring instrument is out of order, it is easy to replace it with another instrument.

According to the compressor of the second aspect of the present invention, temperature of the refrigerant will be closer to that of the refrigerant just discharged from the discharge port as a flowing position of the refrigerant gets closer to the discharge port. Therefore, it is possible to accurately measure temperature of the just-discharged refrigerant by disposing the closed end of the pipe in the vicinity of the discharge port.

According to the compressor of the third aspect of the present invention, even when a low-pressure space is provided between the casing and the refrigerant passage and there is a significant difference between temperature of the outer surface of the casing and temperature of the refrigerant flowing through the refrigerant passage, it is possible to accurately measure temperature of the refrigerant in the refrigerant passage because the pipe extends from the inside of the refrigerant passage to the outside of the casing.

According to the compressor of the fourth aspect of the present invention, it is possible to measure temperature of the refrigerant roughly the same as that of the refrigerant just discharged from the compression mechanism. Additionally, the space, produced between the casing and the guide plate, is a relatively large space of the refrigerant passage in the casing. Therefore, it is possible to insert the pipe all the way into the casing. Moreover, even when the pipe is inserted all the way into the casing, this does not influence the refrigerant flow.

According to the compressor of the fifth aspect of the present invention, it is possible to measure temperature of the refrigerant roughly the same as that of the refrigerant just discharged from the compression mechanism. Additionally, the first recess and/or the second recess are/is a relatively large space(s) of the refrigerant passage in the casing. Therefore, it is possible to insert the pipe all the way into the casing. Moreover, even when the pipe is inserted all the way into the casing, this does not influence the refrigerant flow.

According to the compressor of the sixth aspect of the present invention, it is possible to fix the pipe while the pipe does not make contact with the casing. Therefore, influence of temperature to be transferred from the casing will be reduced and response with respect to the refrigerant temperature will be enhanced.

According to the compressor of the seventh aspect of the present invention, influence of temperature to be transferred from the casing will be further reduced and response with respect to the refrigerant temperature will be further enhanced.

According to the compressor of the eighth aspect of the present invention, it is possible to more accurately measure the refrigerant temperature than when a temperature sensor is disposed in the vicinity of the discharge pipe. Additionally, response with respect to the refrigerant temperature will be enhanced.

According to the compressor of the ninth aspect of the present invention, it is possible to more accurately measure the refrigerant temperature than when a temperature sensor is disposed in the vicinity of the discharge pipe. Additionally, response with respect to the refrigerant temperature will be enhanced.

According to the compressor of the tenth aspect of the present invention, it is possible to accurately measure temperature of the refrigerant flowing through a predetermined position only by making the temperature measuring instrument come in contact with the closed end of the pipe, made of high thermal conductivity material.

According to the compressor of the eleventh aspect of the present invention, it is possible to measure temperature of the refrigerant flowing through a predetermined position. Additionally, it is easy to dispose the measuring instrument only by inserting it from the opened end of the pipe.

According to the compressor of the twelfth aspect of the present invention, it is possible to press the measuring instrument to the pipe without any clearance. Accordingly, response with respect to the refrigerant temperature will be enhanced.

According to the compressor of the thirteenth aspect of the present invention, it is possible to accurately measure temperature of the refrigerant flowing through a predetermined position even when carbon dioxide is used as the refrigerant.

According to a refrigerant apparatus of the fourteenth aspect of the present invention, it is possible to perform an optimum operational control of the refrigeration apparatus corresponding to the refrigerant temperature in the interior of the compressor.

DETAILED DESCRIPTION OF THE INVENTION

First Embodiment

1. Structure of Scroll Compressor

Figure 1:
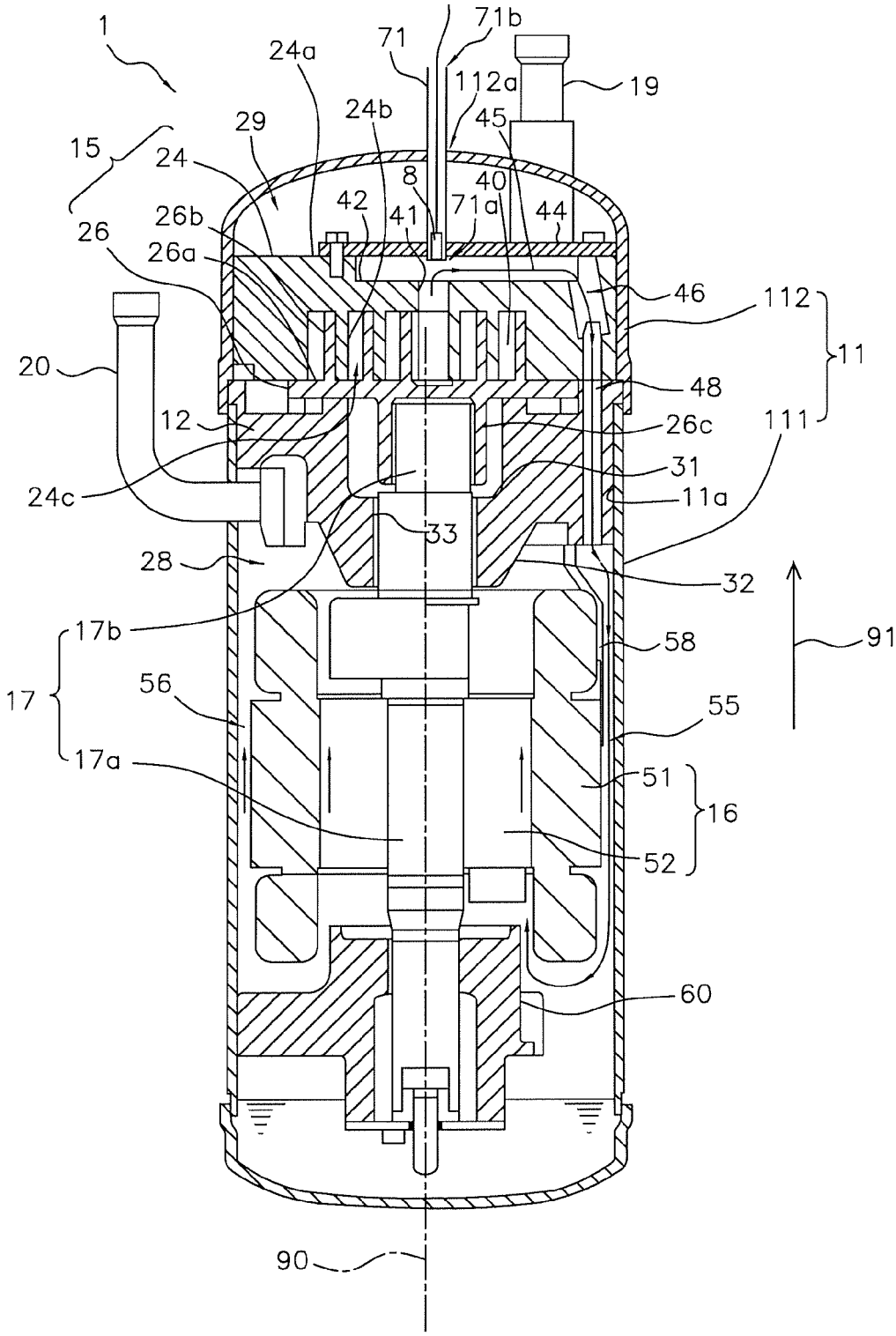
FIG. 1 is a schematic diagram of a pipe 71 disposed in a scroll compressor 1 according to a first embodiment of the present invention.

FIG. 1 is a schematic diagram of a scroll compressor 1 according to a first embodiment of the present invention. Note a direction 91 is illustrated in FIG. 1. The tip side of the arrow of the direction 91 is referred to as "an upper side" whereas the other side thereof is referred to as "a lower side."

The scroll compressor 1 includes a casing 11, a fix (fixed) member 12, a compression mechanism 15, a motor 16, a crank shaft 17, a suction pipe 19, a discharge pipe 20 and a bearing 60.

The casing 11 includes a tube 111 and a cover 112. The tube 111 extends along the direction 91. The cover 112 covers an upper end of the tube 111. The casing 11 accommodates the fix member 12, the compression mechanism 15, the motor 16, the crank shaft 17 and the bearing 60.

The motor 16 includes a stator 51 and a rotor 52. The stator 51 is formed in an annular shape. The stator 51 is fixed to an inner wall 11*a* of the casing 11. The rotor 52 is disposed in the inner peripheral side of the stator 51. The rotor 52 is opposed to the stator 51 through an air gap.

The crank shaft 17 extends along the direction 91. The crank shaft 17 includes a main shaft 17*a* and an eccentric portion 17*b*. The main shaft 17*a* is configured to rotate around a rotational shaft 90. The main shaft 17*a* is connected to the rotor 52. The eccentric portion 17*b* is disposed eccentrically from the rotational shaft 90. The eccentric portion 17*b* is connected to the upper side of the main shaft 17*a*. The lower end of the crank shaft 17 is slidably supported by the bearing 60.

In FIG. 1, the fix member 12 is specifically a housing portion. The fix member 12 is fitted in the inner wall 11*a* of the casing 11 without any clearance. For example, the fix member 12 is fitted in the inner wall 11*a* using a method of press fitting, shrink fitting or the like. The fix member 12 may be fitted in the inner wall 11*a* through a sealing member.

The fix member 12 is fitted in the inner wall 11*a* without any clearance. The fix member 12 accordingly separates a space 28 positioned below the fix member 12 and a space 29 positioned above the fix member 12 without any clearance. Therefore, the fix member 12 is capable of retaining a pressure difference between the space 28 and the space 29. As described below, the refrigerant flows into the space 28 after it is compressed by the compression mechanism 15. Therefore, pressure in the space 28 is high whereas pressure in the space 29 is low.

The fix member 12 includes an upwardly opened recess 31. The recess 31 is disposed in the vicinity of the rotational shaft 90. The eccentric portion 17*b* of the crank shaft 17 is accommodated in the recess 31. Moreover, the fix member 12 includes a bearing 32 and a hole 33. The bearing 32 supports the main shaft 17*a* of the crank shaft 17 while the main shaft 17*a* penetrates through the hole 33.

The compression mechanism 15 includes a stationary scroll 24 and a movable scroll 26. The compression mechanism 15 is configured to compress the refrigerant. For example, a type of refrigerant, including carbon dioxide as a main constituent, can be used.

The stationary scroll 24 includes a mirror plate 24*a* and a compression member 24*b*. The mirror plate 24*a* is fixed to the inner wall 11*a* of the casing 11, whereas the compression member 24*b* is connected to the lower side of the mirror plate 24*a*. The compression member 24*b* extends in a spiral shape. A groove 24*c* is formed between the spirals of the compression member 24*b*.

The upper surface of the stationary scroll 24 is formed in a recessed shape. A space 45, surrounded by a recessed portion 42 of the upper surface of the stationary scroll 24, is covered with a cover 44. The cover 44 separates two spaces having different pressures, that is, the space 45 and the space 29 positioned above the space 45.

The movable scroll 26 includes a mirror plate 26*a*, a compression member 26*b* and a bearing 26*c*. The compression member 26*b* is connected to the upper side of the mirror plate 26*a*. The compression member 26*b* extends in a spiral shape.

The compression member 26*b* is accommodated in the groove 24*c* of the stationary scroll 24. In the compression mechanism 15, a space 40 formed between the compression member 24*b* and the compression member 26*b* is sealed by the mirror plates 24*a* and 26*a*. The sealed space 40 is used as a compression chamber.

The bearing 26*c* is connected to the lower side of the mirror plate 26*a*. The bearing 26*c* slidably supports the eccentric portion 17*b* of the crank shaft 17.

2. Refrigerant Flow

A refrigerant flow in the scroll compressor 1 will be hereinafter explained with reference to FIG. 1. In FIG. 1, the refrigerant flow is illustrated with arrows. The refrigerant is sucked into the scroll compressor 1 through the suction pipe 19. The sucked refrigerant is subsequently guided to the compression chamber (i.e., the space 40) of the compression mechanism 15. The refrigerant is compressed in the compression chamber (i.e., the space 40). The compressed refrigerant is discharged to the space 45 through a discharge port 41 disposed in the vicinity of the center of the stationary scroll 24. Therefore, pressure in the space 45 is high. On the other hand, pressure in the space 29 separated from the space 45 by the cover 44 remains to be low.

The refrigerant in the space 45 sequentially flows through a hole 46 and a hole 48, and arrives at the space 28 positioned below the fix member 12. Here, the hole 46 is formed in the stationary scroll 24, whereas the hole 48 is formed in the fix member 12. In the space 28, the refrigerant is guided to a clearance 55 by a guide plate 58. The clearance 55 is produced between the casing 11 and a part of the lateral side of the stator 51.

The refrigerant flows through the clearance 55 and arrives at below the motor 16. The refrigerant further flows toward the discharge pipe 20 through an air gap of the motor 16 or a clearance 56. The clearance 56 is produced between the casing 11 and another part of the lateral side of the stator 51.

Considering the fact that the refrigerant discharged from the discharge port 41 sequentially passes through the space 45, the hole 46 and the hole 48 in this order, it is possible to treat the space 45, the hole 46 and the hole 48 as refrigerant passages. Further considering the fact that the space 45, the hole 46 and the hole 48 are disposed in the casing 11, it is possible to comprehend that the refrigerant passages are disposed in interior of the casing 11.

3. Pipe Disposition

First Embodiment

The aforementioned scroll compressor 1 further includes a pipe 71 (see FIG. 1). The pipe 71 extends from the inside to the outside of the casing 11.

The pipe 71 includes two ends. One is an end 71*a*, and the other is an end 71*b*. The end 71*a* is a closed end disposed in the space 45 functioning as a refrigerant passage. The end 71*b* is an opened end disposed outside the casing 11. In FIG. 1, the pipe 71 penetrates through the cover 112 while linearly extending along the direction 91.

According to the disposition of the pipe 71, it is easier to seal a pipe, extending from the inside to the outside of a casing, than to seal a wire and the like. Additionally, it is possible to measure temperature of the refrigerant flowing through the space 45 only by inserting a measuring instrument 8 for measuring temperature (hereinafter simply referred to as "measuring instrument") from the end 71*b* of the pipe 71. Moreover, even when the measuring instrument 8 is out of order, it is easy to replace it with another instrument.

In view of accurately measuring the refrigerant temperature using the measuring instrument 8 inserted into the pipe 71, at least the end 71*a* of the pipe 71 is made of high thermal conductivity material. Also, the measuring instrument 8 makes contact with the end 71*a*.

The end 71*a* of the pipe 71 is disposed close to the discharge port 41 within the space 45 (see FIG. 1). Temperature of the refrigerant will be closer to that of the refrigerant just discharged from the discharge port 41 as a flowing position of the refrigerant gets closer to the discharge port 41. Therefore, disposing the end 71*a* of the pipe 71 close to the discharge port 41 enables accurate measurement of temperature of the just-discharged refrigerant.

The pipe 71 passes through the space 29, which is different from the space 45, and extends from the space 45 to the outside of the casing 11 (see FIG. 1). As described above, pressure in the space 29 is lower than that in the space 45.

When the low-pressure space 29 is provided between the casing 11 and the space 45, a significant difference is easily produced between temperature of the outer surface of the casing 11 and temperature of the refrigerant flowing through the space 45. According to the pipe 71 mentioned above, however, it is possible to guide the measuring instrument 8 into the space 45 only by inserting the measuring instrument 8 from the end 71*b* of the pipe 71. Therefore, even when the space 29 is provided, it is possible to accurately measure temperature of the refrigerant flowing through the space 45.

A variety of means for measuring temperature may be adopted as the measuring instrument 8 as long as it is capable of measuring the refrigerant temperature. For example, it is possible to adopt a variety of means for measuring temperature such as a temperature resistor, a thermister and a thermocouple.

Second Embodiment

Figure 2:
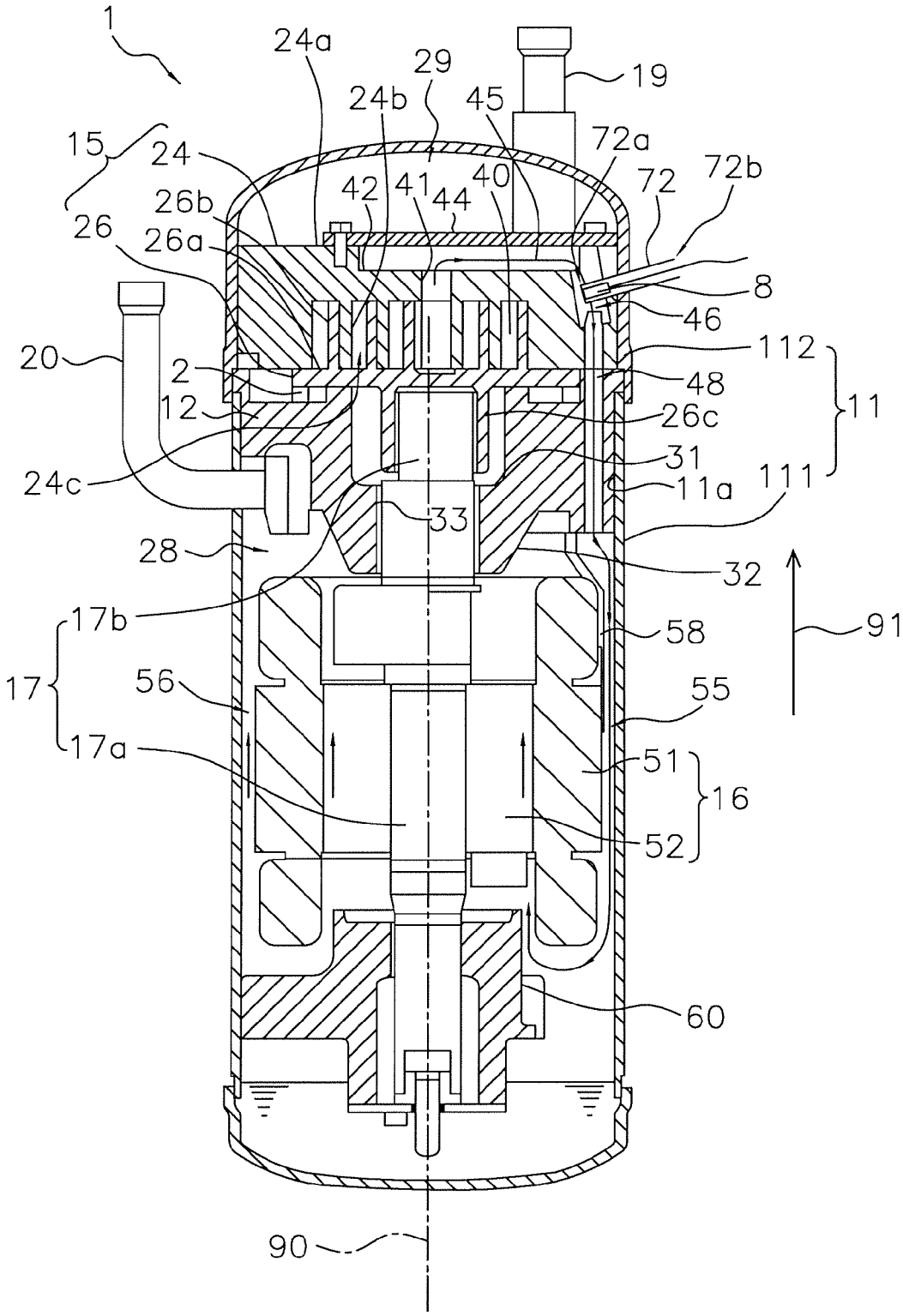
FIG. 2 is a schematic diagram of a pipe 72 disposed in the scroll compressor 1 according to the first embodiment of the present invention.
Figure 3:
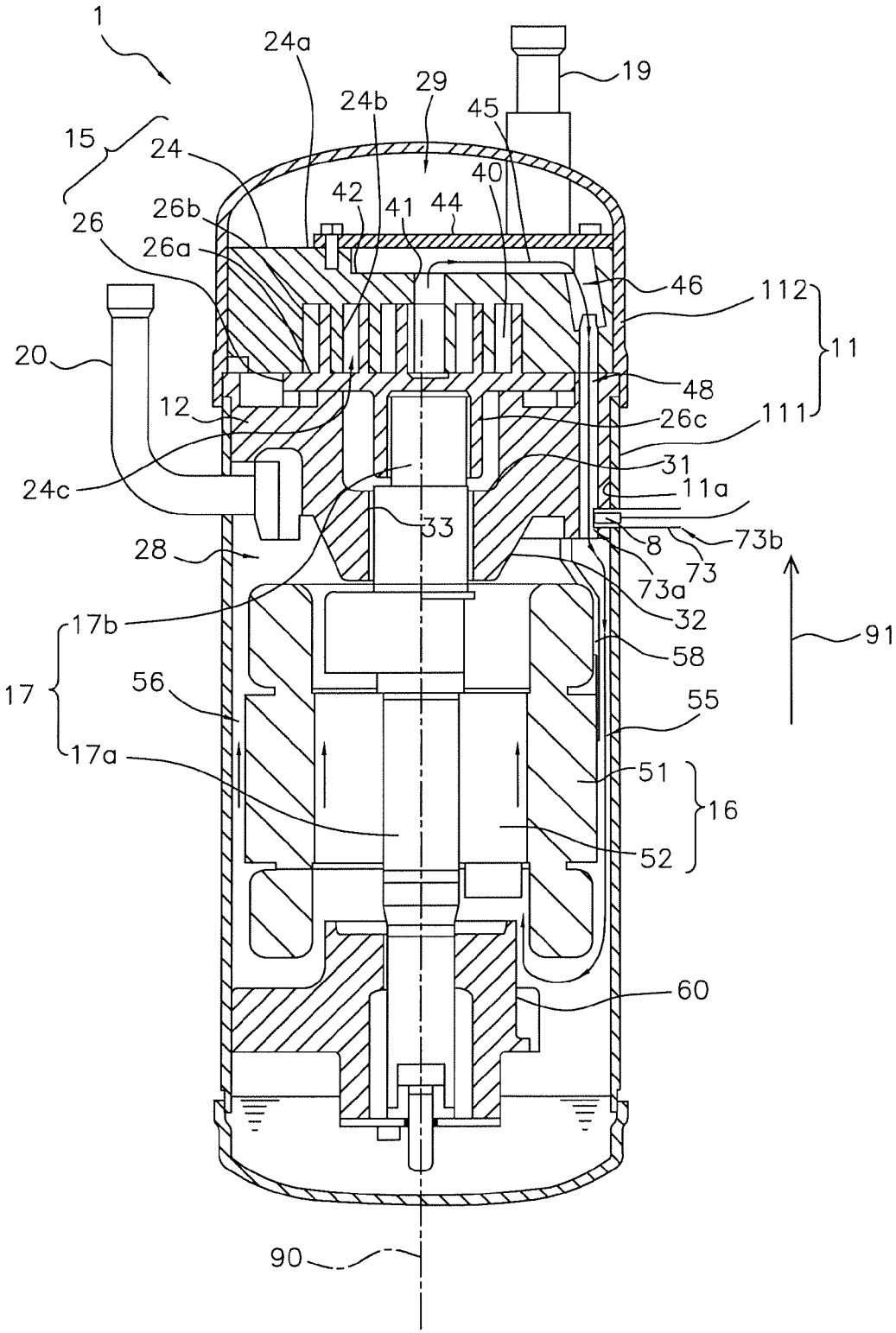
FIG. 3 is a schematic diagram of a pipe 73 disposed in the scroll compressor 1 according to the first embodiment of the present invention.

FIG. 2 illustrates a pipe 72 disposed in a different position from the pipe 71 illustrated in FIG. 1, whereas FIG. 3 illustrates a pipe 73 disposed in a different position from the pipe 71. Note the other components illustrated in FIGS. 2 and 3 are the same as those illustrated in FIG. 1. Therefore, explanation of the other components will be hereinafter omitted.

The pipe 72, illustrated in FIG. 2, has two ends. One is an end 72*a*, and the other is an end 72*b*. The end 72*a* is a closed end disposed in the hole 46 functioning as a refrigerant passage. The end 72*b* is an opened end disposed outside the casing 11. In FIG. 2, the pipe 72 penetrates through the cover 112 of the casing 11. The pipe 72 slants with respect to the direction 91 and linearly extends obliquely upward.

The pipe 73, illustrated in FIG. 3, has two ends. One is an end 73*a*, and the other is an end 73*b*. The end 73*a* is a closed end disposed in the hole 48 functioning as a refrigerant passage. The end 73*b* is an opened end disposed outside the casing 11. In FIG. 3, the pipe 73 penetrates through the tube 111. The pipe 73 linearly extends to the vertical direction with respect to the direction 91.

Similarly to the pipe 71, it is easy to seal the pipes 72 and 73. Moreover, it is possible to measure temperature of the refrigerant flowing through the holes 46 and 48.

Third Embodiment

Each of FIGS. 1 to 3 illustrates the scroll compressor 1 that only each of the pipes 71 to 73 is disposed therein respectively. However, at least any two of the pipes 71 to 73 may be disposed in the same scroll compressor 1, for instance.

Other Embodiment

The scroll compressor 1 may be provided with a pipe extending to the outside of the casing 11 from the space 28, specifically from the clearance 55 or the clearance 56.

Temperature of the refrigerant discharged from the discharge port 41 tends to be changed until the refrigerant flows into the space 28. For example, temperature of the motor 16 is low immediately after the scroll compressor 1 is started to be operated. Accordingly, the motor 16 absorbs heat of the refrigerant and refrigerant temperature will be reduced.

However, when an operation of the scroll compressor 1 is stabilized after it is started to be driven, temperature of the refrigerant flowing through the space 28 will be close to that of the just-discharged refrigerant. For example, temperature of the motor 16 will be increased as time passes since the scroll compressor 1 is started to be operated. Accordingly, the amount of heat absorbed by the motor 16 will be reduced. As a result, even when the pipe of the present embodiment is used, it is possible to measure temperature of the just-discharged refrigerant.

4. Example Modification

The aforementioned disposition of the pipes 71 to 73 may be applied to another type of compressor (e.g., a rotary compressor).

5. Manufacturing Method of Compressor

Figure 4:
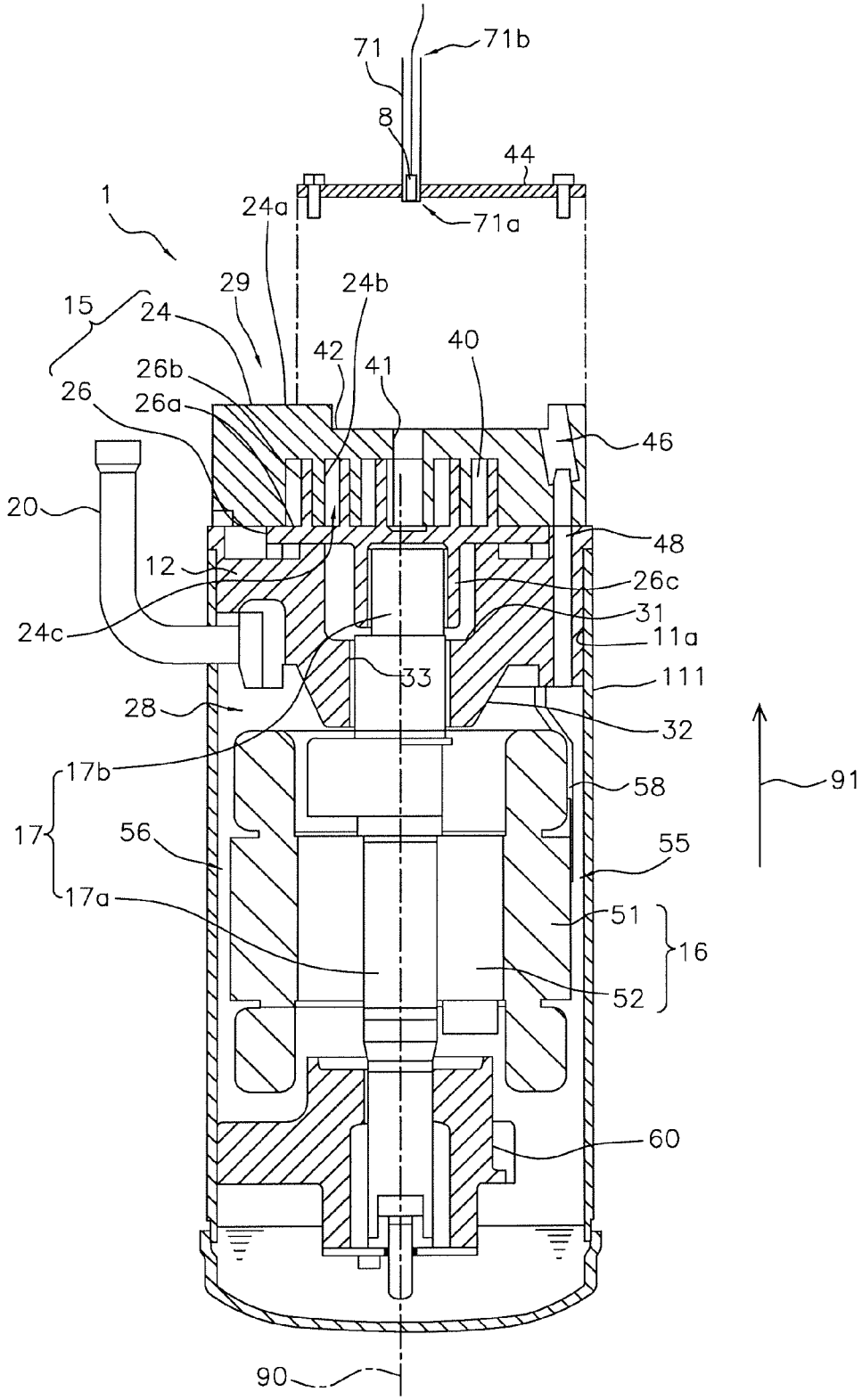
FIG. 4 is a schematic diagram for illustrating a method of manufacturing the scroll compressor illustrated in FIG. 1.
Figure 5:
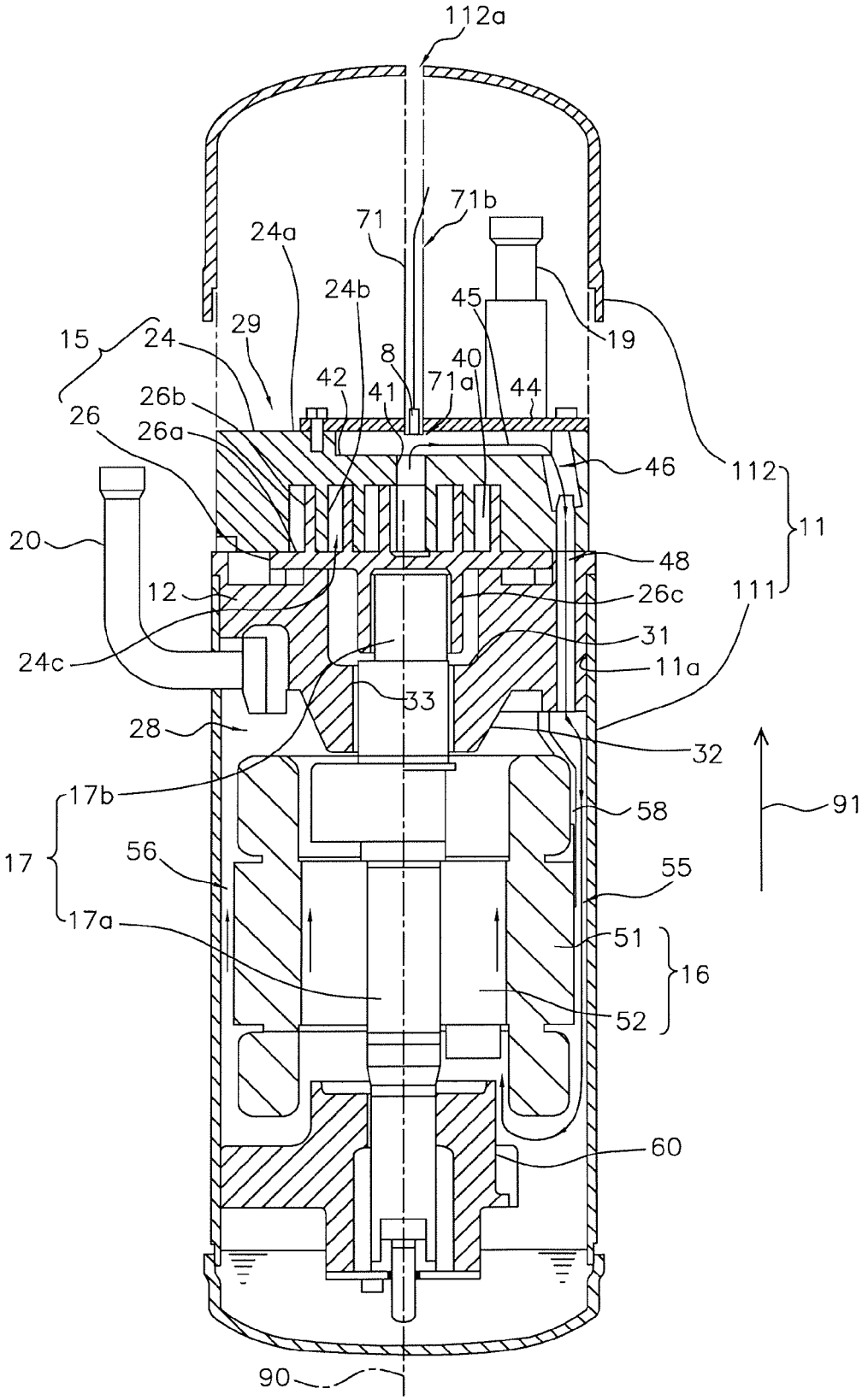
FIG. 5 is a schematic diagram for illustrating a method of manufacturing the scroll compressor illustrated in FIG. 1.

FIGS. 4 and 5 in process sequence illustrate steps of a method of manufacturing the scroll compressor 1 illustrated in FIG. 1. The manufacturing method is composed of steps (a) and (b).

In the step (a), the end 71*a* of the pipe 71 is disposed in a predetermined position in the space 45 functioning as a refrigerant passage, for instance, in a position close to the discharge port 41 (see FIGS. 1 and 4).

Specifically, the pipe 71 penetrates the cover 44, and the end 71*a* of the pipe 71 is accordingly protruded to the opposite side to the end 71*b* with respect to the cover 44 (see FIG. 4). Simultaneously with or immediately after this, a clearance, produced between the cover 44 and the pipe 71 penetrating the cover 44, is sealed.

Subsequently, the portion 42, formed on the upper side of the stationary scroll 24, is covered with the cover 44 in which the end 71*a* is directed downward (see FIG. 4). Accordingly, the end 71*a* of the pipe 71 is laterally protruded into the space 45 with respect to a direction that the space 45 is extended. The end 71*a* of the pipe 71 is thus positioned in the space 45 (see FIG. 1).

In the step (b), an upper end of the tube 111 is covered with the cover 112 after the step (a) is performed. Specifically, the cover 112 is provided with a through hole 112*a*. The upper end of the tube is covered with the cover 112 while the pipe 71 is inserted into the through hole 112*a* (see FIG. 5). Accordingly, the pipe 71 passes through the through hole 112*a* and extends from the inside of the space 45 to the outside of the casing 11 (see FIG. 1).

According to the aforementioned method, the pipe 71 is disposed before the end of the tube 111 is covered with the cover 112. Therefore, it is easy to perform sealing of the disposed pipe 71. Especially, in the aforementioned specific example (see FIG. 3), the clearance, produced between the pipe 71 and the cover 44, is sealed before the portion 42 is covered with the cover 44. Therefore, sealing is further easily performed.

After the attachment of the cover 112, it is possible to easily seal the through hole 112*a* that the pipe 71 penetrates from the outside of the cover 112.

In FIG. 5, the pipe 71 linearly extends upward along the direction 91 after the step (a) is performed. The shape of the pipe 71 makes it easy to insert the pipe 71 into the through hole 112*a*.

Second Embodiment

<Structure of Scroll Compressor 201>

Figure 6:
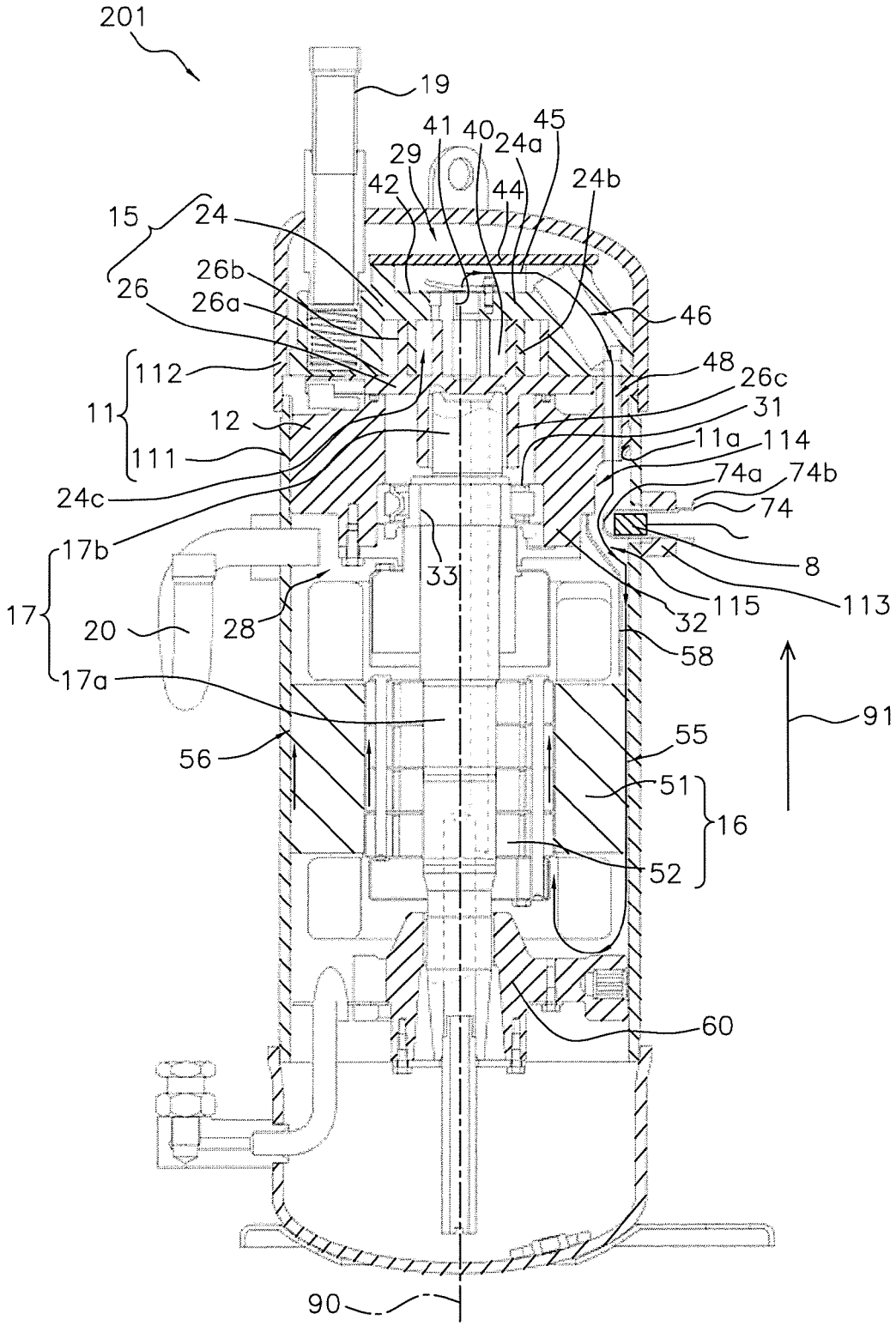
FIG. 6 is a schematic diagram of a scroll compressor 201 according to a second embodiment of the present invention, in which a pipe 74 is disposed.

FIG. 6 is a schematic diagram of a scroll compressor 201 according to a second embodiment of the present invention. The scroll compressor 201 illustrated in FIG. 6 has basically the same structure with the scroll compressor 1 illustrated in FIG. 1. When reference numerals in FIG. 6 correspond to those of FIG. 1, the corresponding reference numerals indicate the same component in FIGS. 1 and 6.

In short, the scroll compressor 201, illustrated in FIG. 6, includes a casing 11, a fix member 12, a compression mechanism 15, a motor 16, a crank shaft 17, an suction pipe 19, a discharge pipe 20, a bearing 60 and a guide plate 58.

Note in the fix member 12 illustrated in FIG. 6 a recess 31 and a hole 33 are formed by a roller bearing fitted with the fix member 12.

The motor 16 is disposed below the compression mechanism 15. The motor 16 functions as a driving source of the compression mechanism 15. The motor 16 is configured to rotationally drive the crank shaft 17 concentrically fixed to a rotor 52. Accordingly, a movable scroll 26, rotatably supported by an eccentric portion 17*b* of the crank shaft 17, is rotated. This changes the volume of the compression chamber (i.e., the space 40) formed by the movable scroll 26 and a stationary scroll 24 of the compression mechanism 15. As a result, the refrigerant is compressed and discharged from a discharge port 41.

Figure 7:
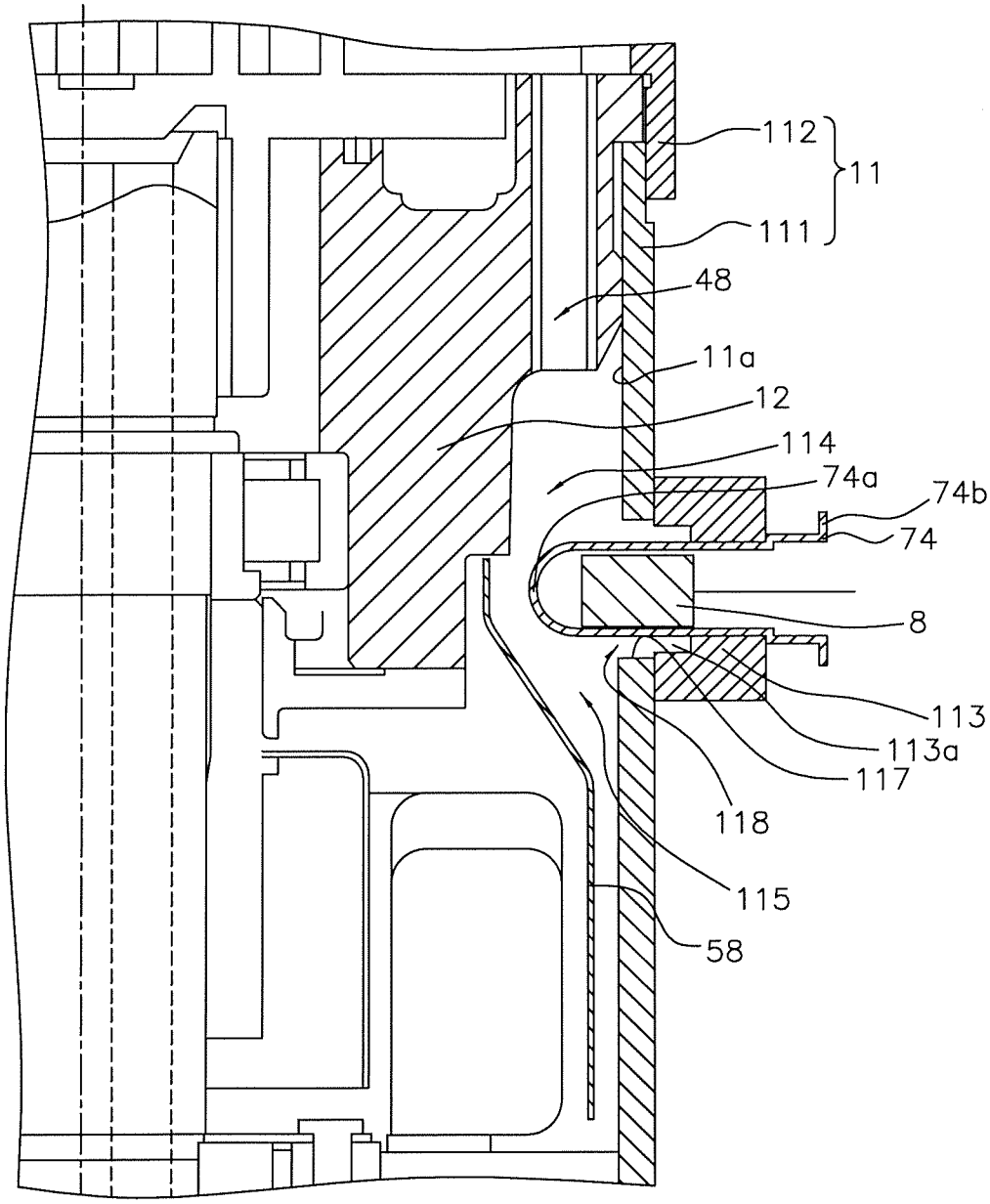
FIG. 7 is a partially-enlarged schematic vertical cross sectional view of an attachment portion of the pipe 74 in FIG. 6 and its adjacent area.
Figure 8:
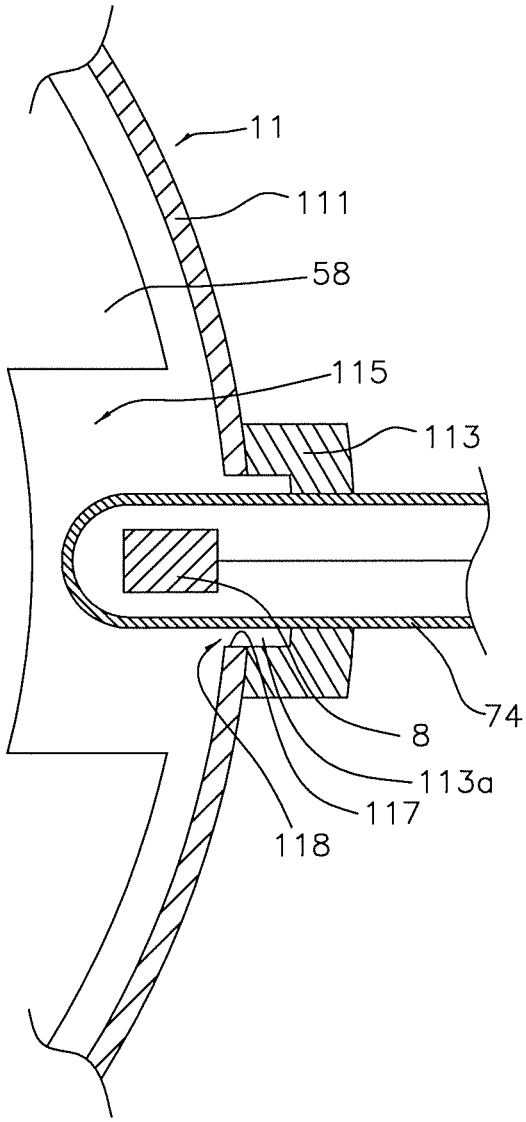
FIG. 8 is a partially-enlarged schematic transverse cross sectional view of the attachment portion of the pipe 74 in FIG. 6 and its adjacent area.

As illustrated in FIGS. 6 to 8, the guide plate 58 is disposed on the outer periphery of the motor 16. The guide plate 58 guides the refrigerant, compressed and discharged from the compression mechanism 15, to a clearance 55 produced between the outer peripheral surface of the motor 16 and a tube 111.

The fix member 12 rotatably supports the crank shaft 17 connecting the compression mechanism 15 and the motor 16. The fix member 12 includes a first recess 114 in the lower end of the outer periphery thereof. The first recess 114 is recessed in a direction away from an inner wall 11*a* of the casing 11. The first recess 114 communicates with a hole 48 of the fix member 12.

The guide plate 58 includes a second recess 115 in the upper end of the outer periphery thereof. The second recess 115 is recessed in a direction away from the inner wall 11*a* of the casing 11. The second recess 115 communicates with the first recess 114 of the fix member 12.

In the second embodiment, the first recess 114 and second recess 115 form a part of a space 28 positioned below the fix member 12.

<Explanation of Pipe 74>

The aforementioned scroll compressor 201 further includes a pipe 74 (see FIG. 6). The pipe 74 extends from the inside to the outside of the casing 11.

Specifically, the pipe 74, illustrated in FIGS. 6 to 8, includes two ends. One is an end 74*a* and the other is an end 74*b*. The end 74*a* is a closed end positioned in the first recess 114 and/or the second recess 115 (in FIG. 6, in a position astride the first recess 114 and the second recess 115). The end 74*b* is an opened end positioned outside the casing 11. In FIG. 6, the pipe 74 penetrates through the tube 111 while linearly extending in a vertical direction to a direction 91.

Similarly to the pipe 71, it is easy to seal the pipe 74. Accordingly, it is possible to accurately measure temperature of the refrigerant flowing through the first recess 114 and/or the second recess 115, positioned above the motor 16. Moreover, the measurement position is above the motor 16. It is thereby possible to measure the refrigerant temperature, roughly the same as temperature of the refrigerant just discharged from the compression mechanism 15, without being influenced by refrigerant temperature reduction due to the contact with the motor 16.

Furthermore, the first recess 114, which is produced between the fix member 12 and the tube 111 of the casing 11, and the second recess 115, which is produced between the guide plate 58 and the tube 111 of the casing 11 respectively, are relatively large spaces of the refrigerant passage in the casing 11. Therefore, it is possible to insert the pipe 74 all the way into the casing 11. Even when the pipe 74 is inserted all the way into the casing 11, this does not influence the refrigerant flow.

With the disposition of the pipe 74, it is easier to seal the pipe 74 extending from the inside to the outside of the casing 11 than to seal a wire and the like. Additionally, it is possible to measure temperature of the refrigerant flowing through the first recess 114 or the second recess 115 only by inserting the temperature measuring instrument 8 from the end 74*b* of the pipe 74. Moreover, even when the measuring instrument 8 is out of order, it is easy to replace it with another instrument.

In view of accurately measuring refrigerant temperature using the measuring instrument 8 inserted into the pipe 74, at least the end 74*a* of the pipe 74 is made of high thermal conductivity material (e.g., copper). Additionally, the measuring instrument 8 makes contact with the end 74*a*.

Moreover, the thickness of the pipe 74 is thinner than that of the discharge pipe 20. Therefore, it is possible to more accurately measure the refrigerant temperature than when a temperature sensor is disposed in the vicinity of the discharge pipe 20.

Additionally, the outer diameter of the pipe 74 is smaller than that of the discharge pipe 20. Therefore, it is possible to more accurately measure the refrigerant temperature than when a temperature sensor is disposed in the vicinity of the discharge pipe 20. Also, pressure resistance of the pipe 74 is enhanced and the thickness thereof is reduced by reducing the outer diameter of the pipe 74.

<Explanation of Joint 113>

Moreover, the scroll compressor 201 further includes a joint 113. The joint 113 fixes the pipe 74 to the interior of an opening 117 formed in the tube 111 of the casing 11.

As illustrated in FIG. 7, the joint 113 holds the pipe 74 so that a clearance 118 is produced between the pipe 74 and the inner peripheral edge of the opening 117. It is thereby possible to fix the pipe 74 in a state in which the pipe 74 does not make contact with the casing 11. Additionally, the joint 113 includes a recess 113*a* on a surface thereof making contact with the casing 11. Therefore, it is possible to reduce heat to be transferred from the casing 11 to the pipe 74 via the joint 113.

The joint 113 is manufactured with a type of material having lower thermal conductivity than the pipe 74. The material of the joint 113 also has sufficient resistance to high pressure in the compressor 201. For example, when the pipe 74 is manufactured with copper, the joint 113 is manufactured with material having lower thermal conductivity than copper (e.g., iron).

In the present invention, a method of joining the joint 113 to the other components is not particularly limited. For example, the joint 113 and the pipe 74 are joined with brazing and the like, whereas the joint 113 and the tube 111 of the casing 11 are joined with welding and the like.

Figure 9:
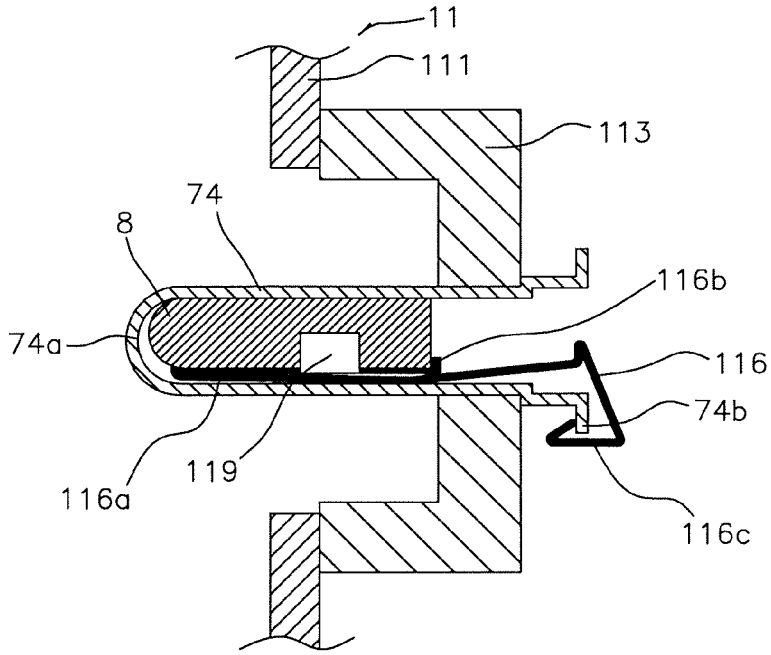
FIG. 9 is a partially-enlarged vertical cross sectional view of the attachment portion of the pipe 74 in FIG. 6 and its adjacent area, and a plate spring is thereby specifically illustrated.

As illustrated in FIG. 9, an attachment position of the measuring instrument 8 is specifically further inward of the casing 11 than the joint 113. Accordingly, influence of temperature to be transferred from the casing 11 will be further reduced.

It is preferable to dispose the measuring instrument 8 in a position immediately below the hole 48 for the enhancement of measurement accuracy. This is because the measuring instrument 8 easily makes contact with refrigerant flow in the position.

<Explanation of Plate Spring 116>

As illustrated in FIG. 9, the scroll compressor 201 further includes a plate spring 116. The plate spring 116 is an elastic element that functions as an elastic means for pressing the measuring instrument 8 disposed in the pipe 74 to the inner wall of the pipe 74. Accordingly, it is possible to make the measuring instrument 8 come in contact with the pipe 74 without any clearance.

The plate spring 116, illustrated in FIG. 9, includes a pressing portion 116*a*, a retaining portion 116*b* and an engaging portion 116*c*. The pressing portion 116*a* is bent in a V-shape. The pressing portion 116*a* applies pressing force to the measuring instrument 8. The retaining portion 116*b* prevents the measuring instrument 8 from getting out of the pipe 74. The engaging portion 116*c* is engaged with a folded-back end 74*b* of the pipe 74. Moreover, the pressing portion 116*a* is provided with a presser plate 119. The presser plate 119 presses a main body of the measuring instrument 8.

Figure 10:
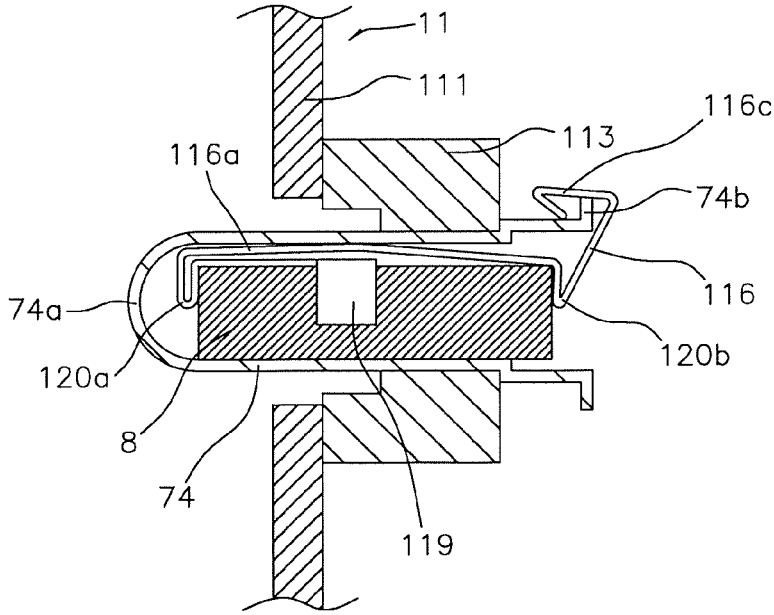
FIG. 10 is a partially-enlarged vertical cross sectional view of the interior of the attachment portion of the pipe 74 according to an example of modification of the second embodiment of the present invention and its adjacent area, and a plate spring is thereby specifically illustrated.

Any suitable elastic means of a variety of shapes may be herein employed as the aforementioned elastic means for pressing the measuring instrument 8 to the inner wall of the pipe 74. For example, the plate spring 116, illustrated in FIG. 10, or any suitable elastic means may be herein employed. In FIG. 10, the plate spring 116 is provided with a pair of protrusions 120*a* and 120*b*. The protrusions 120*a* and 120*b* support the measuring instrument 8 while interposing it therebetween.

<Explanation of Refrigeration Apparatus 300>

A refrigeration apparatus, provided with the aforementioned scroll compressor 201 (hereinafter simply referred to as "the compressor 201"), is capable of performing an operational control (e.g., regulation of the open degree of an expansion valve and the like) based on the refrigerant temperature in the compressor, measured by the measuring instrument 8.

Figure 11:
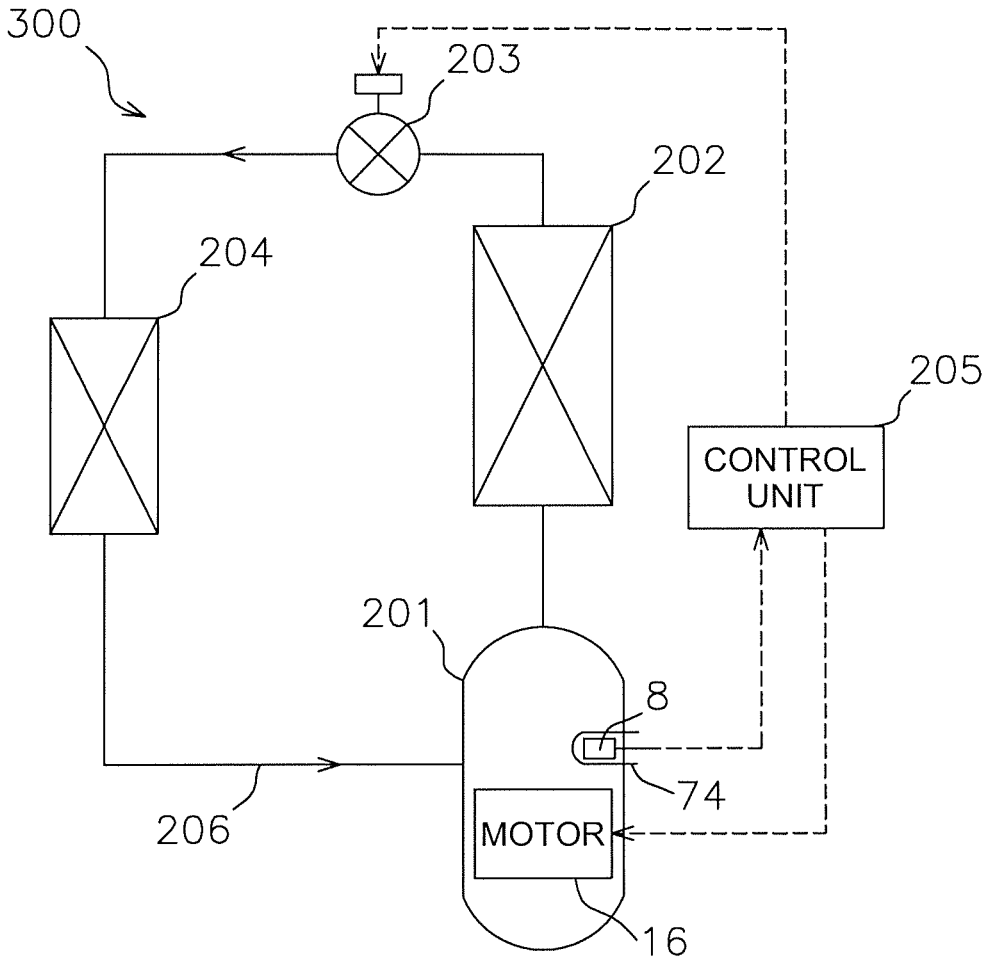
FIG. 11 is a schematic diagram of a refrigeration apparatus 300 using the scroll compressor 201 according to the second embodiment of the present invention.

In short, a refrigeration apparatus 300, illustrated in FIG. 11, includes the compressor 201, the measuring instrument 8 inserted into the aforementioned pipe 74, a condenser 202, an electric expansion valve 203, an evaporator 204 and a control unit 205. The compressor 201, the condenser 202, the electric expansion valve 203 and the evaporator 204 are sequentially connected through a refrigerant piping 206, and thus form a refrigeration circuit.

The measuring instrument 8 is disposed in the pipe 74. The measurement instrument 8 is configured to measure temperature of the refrigerant flowing through the compressor 201.

The condenser 202 communicates with the compressor 201. The condenser 202 is configured to condense the refrigerant compressed by the compressor 201.

The electric expansion valve 203 communicates with the condenser 202. The electric expansion valve 203 is an expansion mechanism configured to expand the refrigerant condensed by the condenser 202. The electric expansion valve 203 is capable of regulating the open degree thereof based on a control signal from the control unit 205. The electric expansion valve 203 is configured to regulate the flow amount of the refrigerant.

The evaporator 204 communicates with the electric expansion valve 203. The evaporator 204 is configured to cool an air in a target space by evaporating the refrigerant expanded by the electric expansion valve 203.

The control unit 205 is configured to at least regulate the open degree of the electric expansion valve 203 based on temperature of the refrigerant flowing through the compressor 201, measured by the measuring instrument 8. Additionally, the control unit 205 is composed of a variety of components such as a microcomputer for controlling the refrigeration apparatus. The control unit 205 is capable of performing a variety of controls other than the regulation of the open degree of the electric expansion valve 203, such as a control of the operational frequency of the motor 16 of the compressor 201 and a control of emergency stop of the compressor 201 and other mechanisms in an emergency situation.

<Characteristics of Second Embodiment>

(1)

In the second embodiment, the end 74*a* of the pipe 74 is disposed in the first recess 114 of the fix member 12 and/or the second recess 115 of the guide plate 58. Therefore, it is possible to accurately measure temperature of the refrigerant flowing through the first recess 114 and/or the second recess 115, positioned above the motor 16. The measurement position is thus above the motor 16. Therefore, it is possible to measure temperature of the refrigerant roughly the same as that of the refrigerant just discharged from the compression mechanism 15, without being influenced by refrigerant temperature reduction due to the contact with the motor 16.

(2)

Additionally, in the second embodiment, the space(s) in which the end 74*a* of the pipe 74 is disposed, that is, the first recess 114 and/or the second recess 115 are/is a relatively large space(s) of the refrigerant passage in the casing 11. Therefore, it is possible to insert the pipe 74 all the way into the casing 11. Moreover, even when the pipe 74 is inserted all the way into the casing 11, this does not influence the refrigerant flow.

(3)

Furthermore, in the second embodiment, the joint 113 holds the pipe 74 so that the clearance 118 is produced between the pipe 74 and the inner peripheral edge of the opening 117. Therefore, it is possible to fix the pipe 74 in a state in which the pipe 74 does not make contact with the casing 11. Therefore, influence of temperature to be transferred from the casing 11 will be reduced, and response of the measuring instrument 8 with respect to the refrigerant temperature will be enhanced.

(4)

Furthermore, in the second embodiment, the measuring instrument 8 is disposed further inward of the casing 11 than the joint 113. Accordingly, influence of temperature to be transferred from the casing 11 will be further reduced, and response of the measuring instrument 8 with respect to the refrigerant temperature will be further enhanced.

(5)

Furthermore, in the second embodiment, the thickness of the pipe 74 is thinner than that of the discharge pipe 20. Therefore, it is possible to more accurately measure the refrigerant temperature than when a temperature sensor is disposed in the vicinity of the discharge pipe 20. Additionally, response of the measuring instrument 8 with respect to the refrigerant temperature will be enhanced.

Note the thickness of each of the pipes 71, 72 and 73 in the first embodiment is thinner than that of the discharge pipe 20. Therefore, it is possible to achieve the same advantageous effects as the above.

(6)

Furthermore, in the second embodiment, the outer diameter of the pipe 74 is smaller than that of the discharge pipe 20. Therefore, it is possible to more accurately measure the refrigerant temperature than when a temperature sensor is disposed in the vicinity of the discharge pipe 20. Additionally, response of the measuring instrument 8 with respect to the refrigerant temperature will be enhanced. Moreover, pressure resistance of the pipe 74 is enhanced by setting the outer diameter of the pipe 74 to be smaller than that of the discharge pipe 20. Therefore, it is possible to reduce the thickness of the pipe 74.

Note the outer diameter of each of the pipes 71, 72 and 73 in the first embodiment is smaller than that of the discharge pipe 20. Therefore, it is possible to achieve the same advantageous effects as the above.

(7)

Furthermore, in the second embodiment, at least the end 74*a* of the pipe 74 is made of high thermal conductivity material. Therefore, it is possible to accurately measure temperature of the refrigerant flowing through the first recess 114 and the second recess 115 only by making the temperature measuring instrument 8 come in contact with the end 74*a* made of high thermal conductivity material.

(8)

Furthermore, in the second embodiment, the temperature measuring instrument 8 is disposed in the pipe 74. Therefore, it is possible to measure temperature of the refrigerant flowing through the first recess 114 and the second recess 115. Additionally, it is easy to dispose of the measuring instrument 8 only by inserting it from the end 74*b* of the pipe 74.

(9)

Furthermore, in the second embodiment, the plate spring 116 is provided for pressing the temperature measuring instrument 8, disposed in the pipe 74, to the inner wall of the pipe 74. Accordingly, it is possible to make the measuring instrument 8 come in contact with the pipe 74 without any clearance. As a result, response of the measuring instrument 8 with respect to refrigerant temperature will be enhanced.

(10)

Furthermore, in the second embodiment, it is possible to accurately measure temperature of the refrigerant flowing through the first recess 114 and the second recess 115 even when the refrigerant includes carbon dioxide as a main constituent.

(11)

Furthermore, according to the refrigeration apparatus 300 of the second embodiment, the control unit 205 is configured to at least regulate the open degree of the electric expansion valve 203 based on temperature of the refrigerant flowing through the compressor 201, measured by the measuring instrument 8 inserted into the pipe 74. Therefore, it is possible to perform an optimum operational control of the refrigeration apparatus corresponding to the refrigerant temperature in the compressor 201. Additionally, the refrigeration apparatus 300 is not required to be provided with any temperature sensors, conventionally provided in the discharge pipe 20 and the like for measuring the refrigerant temperature.

Note when the compressor 1 of the first embodiment is applied to the refrigeration apparatus 300, it is possible to achieve the same advantageous effects as the above.

Example Modifications of Second Embodiment (A)

The aforementioned second embodiment explains an example that both of the first recess 114 of the fix member 12 and the second recess 115 of the guide plate 58 are provided. However, the present invention is not limited to this. For example, as an example modification of the second embodiment, when the first recess 114 of the fix member 12 is not provided, the end 74*a* of the pipe 74 may be disposed in the second recess 115 between the tube 111 and the guide plate 58. In this case, it is possible to achieve the same advantageous effects as the aforementioned second embodiment.

(B)

In the refrigeration apparatus 300 of the second embodiment, the evaporator 204 is configured to cool the air in a target space. However, when flow of the refrigerant in the refrigeration apparatus 300 is reversed using a four-way switch valve (not illustrated in the figure), the evaporator 204, illustrated in FIG. 11, functions as a condenser and is capable of heating the air in the target space. As a result, the refrigeration apparatus 300 is capable of performing both cooling and heating operations. In this case, when the compressor 201 of the second embodiment is used, it is also possible to perform an optimum operational control of the refrigeration apparatus corresponding to the refrigerant temperature in the interior of the compressor 201. Moreover, a temperature sensor is not required to be provided in the discharge pipe 20.

INDUSTRIAL APPLICABILITY

It is possible to widely apply the present invention to a field of a compressor, especially to a field of measurement of refrigerant temperature.

What is claimed is:

1. A compressor for compressing refrigerant, the compressor comprising:

a casing accommodating a refrigerant passage in an interior thereof;

a compression mechanism disposed in the interior of the casing to discharge compressed refrigerant into the refrigerant passageway; and a pipe extending from inside of the casing to outside of the casing, the pipe including two ends, with one of the ends being a closed end disposed in a predetermined position inside the refrigerant passage and the other of the ends being an opened end disposed outside of the casing, the pipe passing through a space in the interior of the casing and extending from inside of the refrigerant passage to outside of the casing, and pressure in the space being different from pressure in the refrigerant passage.

2. The compressor according to claim 1, wherein the compression mechanism includes a discharge port for discharging the compressed refrigerant into an inlet area of the refrigerant passage after the compression mechanism compresses the refrigerant, and the predetermined position of the closed end of the pipe is disposed in the inlet area adjacent the discharge port.

3. The compressor according to claim 1, wherein at least the closed end of the pipe includes a high thermal conductivity material.

4. The compressor according to claim 3, further comprising a temperature measuring instrument disposed in the pipe.

5. The compressor according to claim 1, further comprising a temperature measuring instrument disposed in the pipe.

6. The compressor according to claim 1, wherein the refrigerant includes carbon dioxide as a main constituent.

7. A compressor for compressing refrigerant, the compressor comprising:

a casing accommodating a refrigerant passage in an interior thereof;

a compression mechanism disposed in the interior of the casing to discharge compressed refrigerant into the refrigerant passageway;

a pipe extending from inside of the casing to outside of the casing;

a motor disposed below the compression mechanism, the motor functioning as a driving source of the compression mechanism; and a guide plate disposed on an outer periphery of the motor, the guide plate being configured to guide the refrigerant compressed and discharged by the compression mechanism, the pipe including two ends, with one of the ends being a closed end disposed in a predetermined position inside the refrigerant passage, and the other of the ends being an opened end disposed outside of the casing, and the predetermined position of the closed end of the pipe is disposed between an inner wall of the casing and an outer surface of the guide plate.

8. The compressor according to claim 7, further comprising a discharge pipe configured to discharge the compressed refrigerant outside of the casing, a thickness of the pipe having the closed end is thinner than that of the discharge pipe.

9. The compressor according to claim 7, further comprising a discharge pipe configured to discharge the refrigerant outside of the casing, an outer diameter of the pipe having the closed end is smaller than that of the discharge pipe.

10. A refrigeration apparatus including the compressor according to claim 7, the refrigeration apparatus further comprising a measuring instrument disposed in the pipe, the measuring instrument being configured to measure temperature of refrigerant in the interior of the compressor;

a condenser communicating with the compressor, the condenser being configured to condense the refrigerant compressed by the compressor;

an expansion mechanism communicating with the condenser, the expansion mechanism being configured to expand the refrigerant condensed by the condenser;

an evaporator communicating with the expansion mechanism, the evaporator being configured to cool air in a target space by evaporating the refrigerant expanded by the expansion mechanism; and a control unit configured to at least regulate an opening degree of the expansion mechanism based on the temperature measured by the measuring instrument.

11. The compressor according to claim 7, further comprising a temperature measuring instrument disposed in the pipe.

12. The compressor according to claim 11, further comprising an elastic element arranged to press the temperature measuring instrument disposed in the pipe toward an inner wall of the pipe.

13. A compressor for compressing refrigerant, the compressor comprising:

a casing accommodating a refrigerant passage in an interior thereof;

a compression mechanism disposed in the interior of the casing to discharge compressed refrigerant into the refrigerant passageway;

a pipe extending from inside of the casing to outside of the casing;

a motor disposed below the compression mechanism, the motor functioning as a driving source of the compression mechanism;

a guide plate disposed on an outer periphery of the motor, the guide plate being configured to guide the refrigerant compressed and discharged by the compression mechanism; and a fixed member arranged to rotatably support a shaft connecting the compression mechanism and the motor, the pipe including two ends, with one of the ends being a closed end disposed in a predetermined position inside the refrigerant passage, and the other of the ends being an opened end disposed outside of the casing, the fixed member including a first recess disposed in a lower end of the outer periphery thereof, the first recess being recessed in a direction away from an inner wall of the casing, the guide plate including a second recess disposed in an upper end of an outer periphery thereof, the second recess being recessed in a direction away from the inner wall of the casing, and the predetermined position of the closed end of the pipe being disposed inside the first recess and/or the second recess.

14. The compressor according to claim 13, further comprising a joint arranged to fix the pipe in an opening formed in the casing such that the closed end of the pipe is inside of the casing, the joint holding the pipe so that a clearance is formed between the pipe and an inner peripheral edge of the opening of the casing.

15. The compressor according to claim 14, further comprising a temperature measuring instrument disposed in the pipe, the temperature measuring instrument being positioned further inward of the casing than the joint.

16. The compressor according to claim 13, further comprising a temperature measuring instrument disposed in the pipe.

17. The compressor according to claim 16, further comprising an elastic element arranged to press the temperature measuring instrument disposed in the pipe toward an inner wall of the pipe.

18. A compressor for compressing refrigerant, the compressor comprising:

a casing accommodating a refrigerant passage in an interior thereof;

a compression mechanism disposed in the interior of the casing to discharge compressed refrigerant into the refrigerant passageway;

a pipe extending from inside of the casing to outside of the casing; and a joint arranged to fix the pipe in an opening firmed in the casing such that the closed end of the pipe is inside of the casing, the pipe including two ends, with one of the ends being a closed end disposed in a predetermined position inside the refrigerant passage, and the other of the ends being an opened end disposed outside of the casing, and the joint holding the pipe so that a clearance is formed between the pipe and an inner peripheral edge of the opening of the casing.

19. The compressor according to claim 18, further comprising a temperature measuring instrument disposed in the pipe, the temperature measuring instrument being positioned further inward of the casing than the joint.

20. The compressor according to claim 19, further comprising an elastic element arranged to press the temperature measuring instrument disposed in the pipe toward an inner wall of the pipe.

* * * * *

UNITED STATES PATENT AND TRADEMARK OFFICE

CERTIFICATE OF CORRECTION

PATENT NO. : 8,424,327 B2
APPLICATION NO. : 12/597017
DATED : April 23, 2013
INVENTOR(S) : Yohei Nishide et al.

It is certified that error appears in the above-identified patent and that said Letters Patent is hereby corrected as shown below:

In the Claims

Column 15,
Line 38, “the refrigerant passage and the other of the ends being an” should read -- the refrigerant passage, and the other of the ends being an --.

Column 18,
Line 18, “a joint arranged to fix the pipe in an opening firmed in the” should read -- a joint arranged to fix the pipe in an opening formed in the --.

Signed and Sealed this
Eighteenth Day of June, 2013

Teresa Stanek Rea
*Acting Director of the United States Patent and Trademark Office*